United States Patent [19]

Quallich

[11] Patent Number: 4,955,487

[45] Date of Patent: Sep. 11, 1990

[54] RAFTER GUN RACK

[76] Inventor: Robert J. Quallich, 3001 Hazelhurst Ave., Pittsburgh, Pa. 15227

[21] Appl. No.: 361,505

[22] Filed: Jun. 5, 1989

[51] Int. Cl.[5] ..... A47F 5/00

[52] U.S. Cl. ..... 211/64; 211/1.3; 312/245

[58] Field of Search ..... 211/1.3, 64, 113, 86; 312/245, 248

[56] References Cited

U.S. PATENT DOCUMENTS

| | | | |
|---|---|---|---|
| Re. 31,409 | 10/1983 | Crist | 312/245 X |
| 4,319,792 | 3/1982 | Britt et al. | 312/245 |
| 4,699,437 | 10/1987 | Genereaux | 312/248 |
| 4,733,925 | 3/1988 | Duran et al. | 312/248 |

FOREIGN PATENT DOCUMENTS

| | | | |
|---|---|---|---|
| 654127 | 12/1937 | Fed. Rep. of Germany | 211/64 |

*Primary Examiner*—Robert W. Gibson, Jr.
*Attorney, Agent, or Firm*—William J. Ruano

[57] ABSTRACT

A gun rack case having a pair of side walls having outwardly turned bottom ledges having spaced holes for screwing onto the exposed edges of an ajoining pair of rafters in an attic. The case has a pair of transversely extending, longitudinally spaced partitions with notches on top of said partitions for supporting a plurality of rifles. The case also has a hinged door extending downwardly when in the open position and which is pivotally movable to the horizontal position when in the locked position.

2 Claims, 1 Drawing Sheet

RAFTER GUN RACK

This invention relates to a gun rack that is especially adapted to be mounted between two boards of a rafter or two boards of a basement floor studding.

BACKGROUND OF THE INVENTION

Rifles have generally been stored in closets or under the bed in locked condition in attempts to keep them away from children.

Children, nevertheless, have had access to such rifles, resulting in a dangerous situation, often resulting in loss of life.

SUMMARY OF THE INVENTION

An object of the present invention is to overcome the present danger of access to children of rifles or guns by mounting them between rafters in an attic or between the floor studding of a basement by concealing them when so mounted and locking them in an enclosed casing under lock and key.

A rectangular casing is provided having spaced partitions with notches for mounting a plurality of guns or rifles and having a shelf for storing ammunition and a pivotal door suspended from one side of the casing. The door is provided with a pair of screw latches and a key lock to prevent opening of the door when it is swung into the horizontal or locked position to form a base to the casing.

DESCRIPTION OF THE PREFERRED EMBODIMENT

Figures 1, 2:
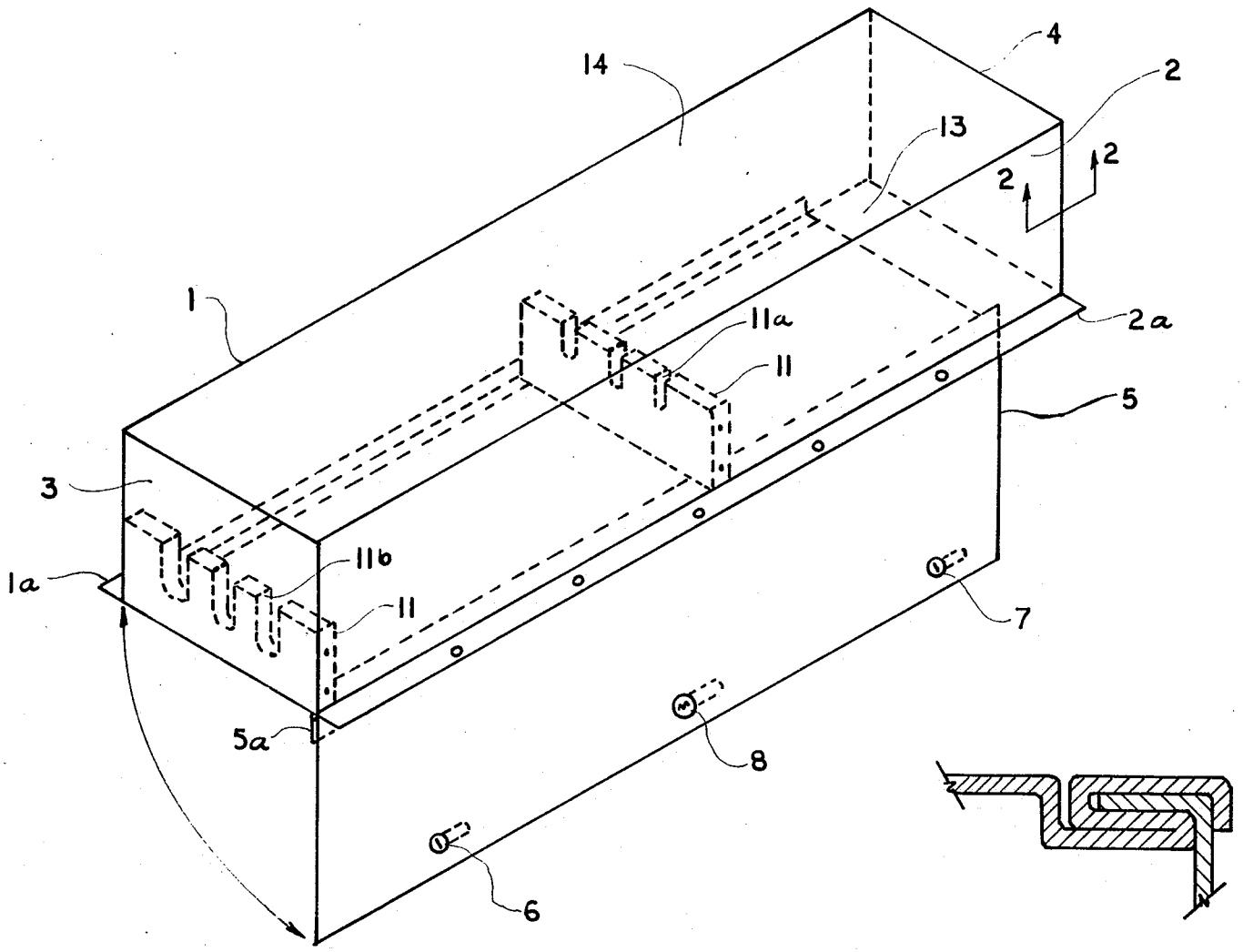
FIG. 1 is a top, perspective view of the gun rack embodying the present invention with the door shown in the suspended or open position.
FIG. 2 is an enlarged cross section of the sealed edge of the casing 1, 2, 3 and 4, taken along line 2—2 of FIG. 1.

Referring to FIG. 1, numerals 1 and 2 denote the side walls of the rack casing and numerals 3 and 4 denote the end walls thereof sealed together as shown in FIG. 2. A door 5 is suspended by a piano type hinge 5*a* so that it can be moved from a vertically suspended position, as shown, to a horizontal position to form the locked base of the gun case. A pair of screw latches 6 and 7 are provided on the door as well as a key lock 8 for locking the door in the horizontal position to an outwardly extending ledge 1*a* of a side wall. Ledge 1*a*, as well as ledge 2*a*, may be screwed onto the end exposed surfaces of a pair of rafters by screws extending through spaced holes on the ledges. A pair of spaced partitions 11 are preferably ¾" thick wood to prevent marring the metal surface of the guns which extend through corresponding longitudinal pairs of notches, such as 11*a* and 11*b*. The sides of the partition are attached by screws to the sides 1 and 2 of the gun case. Three such notches are shown for accomodating 3 rifles. A shelf 13 is provided transversely of the case for storing ammunition. A roof portion 14 is also provided but may be omitted under certain circumstances, such as when the top of the casing is very close to the roofing.

Thus it will be seen that I have provided a gun rack which is completely concealed and out of view of children and which is an economical construction and especially adapted for mounting in the rafter of a attic or between floor studding in a basement.

While I have illustrated and described a single specific embodiment of my invention, it will be understood that this is by way of illustration only and that various changes and modifications may be contemplated in my invention within the scope of the following claims.

I claim:

1. A gun case in combination with a pair of rafters of an attic, for concealment, said gun case comprising a casing including a pair of side walls and a pair of notched partitions spaced longitudinally and extending laterally between said side walls in the case, a pair of outwardly turned ledges extending from the bottom of said side wallks of said gun case, said ledges being perforated to be screwed tightly against the exposed edges of said door including locking means for locking the door to the other of said ledges when pivotally moved at right angles to said sides to form the base of said casing.

2. A gun case in combination with a pair of boards of a floor studding, for concealment, said gun case comprising a casing including a pair of side walls and a pair of notches partitions spaced longitudinally and extending laterally between said side walls in the case, a pair of outwardly turned ledges extending from the bottom of said side walls of said gun case, said ledges being perforated to be screwed tightly against the exposed edges of said pair of boards, and a door hinged to the bottom of one of said ledges, said door including locking means for locking the door to the other of said ledges when pivotally moved at right angles to said sides to form the base of said casing.

* * * * *